United States Patent [19]

Niederhaeuser et al.

[11] 4,415,419

[45] Nov. 15, 1983

[54] PROCESS FOR PRODUCING A CORROSION-RESISTANT SOLID LUBRICANT COATING

[75] Inventors: Paul Niederhaeuser; Michel Maillat, both of Neuchatel; Hans E. Hintermann, Ins, all of Switzerland

[73] Assignee: Laboratoire Suisse de Recherches Horlogeres, Neuchatel, Switzerland

[21] Appl. No.: 393,708

[22] Filed: Jun. 30, 1982

[30] Foreign Application Priority Data

Jun. 30, 1981 [CH] Switzerland ..... 4311/81
Oct. 12, 1981 [CH] Switzerland ..... 6509/81

[51] Int. Cl.[3] ..... C23C 15/00

[52] U.S. Cl. ..... 204/192 C; 204/164; 204/192 D

[58] Field of Search ..... 204/164, 192 C, 192 D, 204/192 SP, 192 N

[56] References Cited

U.S. PATENT DOCUMENTS 4,324,803 4/1982 Bergmann et al. ..... 428/472

FOREIGN PATENT DOCUMENTS 2530002 1/1977 Fed. Rep. of Germany .

OTHER PUBLICATIONS

R. I. Christy, "Sputtered $MoS_2$ Lubricant Coating Improvements", *Thin Solid Films*, vol. 73, pp. 299–307 (1980).

B. C. Stupp, "Synergistic Effects of Metals Co-Sputtered with $MoS_2$", *Thin Solid Films*, vol. 84, pp. 257–266 (1981).

*Thin Solid Films*, vol. 53, (1978), pp. 285–300, "Coatings for Wear & Lubrication".

*Russian Eng. Journal*, vol. 49 (1969), pp. 28–31 –"Performance of Solid Lubricant Coatings".

*Wear*, vol. 43, (1977) pp. 127–140, "Frictional Properties of Solid Lubricants Modified by Polymer Grafting".

*Primary Examiner*—Aaron Weisstuch

*Attorney, Agent, or Firm*—Parkhurst & Oliff

[57] ABSTRACT

A corrosion-resistant surface formed of a sulfide-forming metal, in particular nickel, is first subjected to an electric plasma in an atmosphere containing hydrogen sulfide to form an adherent sulfide on said surface. The sulfided surface is then exposed to simultaneous cathodic sputtering of at least one solid lubricant which is a chalcogen compound of layer structure, in particular $MoS_2$, and at least one hydrophobic solid polymer, in particular PTFE. The coating thus formed is a composite coating in which the particles of the chalcogen compound are coated by the polymer. When the surface of the part to be coated does not consist of a corrosion-resistant sulfide-forming metal, a layer of such a metal is first deposited by cathodic sputtering. The composite coating withstands a wet oxidizing atmosphere, contrary to a coating of $MoS_2$ alone, and the method is applicable to any mechanical part intended to rub on other surfaces, such as a watch balance wheel staff and ball or roller bearings.

19 Claims, No Drawings

PROCESS FOR PRODUCING A CORROSION-RESISTANT SOLID LUBRICANT COATING

Chalcogen compounds of layer structure such as molybdenum sulfide, have already been used successfully as solid lubricants in an environment which is free of oxygen and moisture, for instance in the vacuum of interplanetary space. However, the attempts to use such solid lubricants in the earth's atmosphere, in the presence of oxygen and moisture, have not been successful since these solid lubricants corrode, forming oxidation products, as well as sulfur dioxide and hydrogen sulfide in the case of molybdenum sulfide.

In order to improve the effectiveness of solid lubricants it has been proposed in published German Application DE No. 25 30 002 to graft polymers or other organic or inorganic compounds having suitable reaction sites onto the surface of the solid lubricants.

Furthermore, in an article by T. Spalvins (*Thin Solid Films,* 53, 285–300 (1978), it has been proposed to deposit layers of solid lubricants by cathodic sputtering. The solid lubricants thus deposited separately by this author include molybdenum sulfide and hydrophobic solid polymers, in particular polymides and polytetrafluorethylene, abbreviated herein as "PTFE."

However, these known methods do not make it possible to obtain coatings of solid lubricants which are sufficiently durable in the earth's atmosphere and which adhere sufficiently to their support.

The object of the invention is to overcome these drawbacks and for this purpose the object of the invention is a process of producing a corrosion-resistant solid lubricant coating on a corrosion-resistant surface formed of a sulfide-forming metal, characterized by subjecting the surface to a plasma in an atmosphere containing hydrogen sulfide so as to form an adherent sulfide on said surface and exposing the sulfided surface to simultaneous cathodic sputtering of at least one solid lubricant, selected from among layer-structured chalcogen compounds and at least one hydrophobic solid polymer so as to form a composite coating in which the particles of the chalcogen compound are protected by the hydrophobic polymer, with the atmosphere in which the sulfiding and the depositing of the coating take place being devoid of free or combined oxygen.

Normally the sulfiding treatment of the surface to be coated is carried out in the cathodic sputtering apparatus used for the depositing of the composite solid lubricant. For this sulfiding, one maintains an atmosphere of an inert gas, such as argon, containing hydrogen sulfide in a proportion which may vary between 0.5 and 20% by volume, under a pressure generally of between 0.1 millibars and 0.0001 millibars, and more particularly between 0.06 millibars and 0.0001 millibars, and maintaining an electric discharge between the part to be coated, acting as anode, and a cathode. The hydrogen sulfide, probably in ionized form, reacts effectively with the sulfide-forming metal.

By "sulfide-forming metal," there is understood here a metal which can be sulfided when it is exposed as an electrode to an electric plasma in an atmosphere containing hydrogen sulfide. The sulfide-forming metal may be selected from among nickel, cobalt, chromium, molybdenum, copper, silver, rhodium, ruthenium, tungsten, palladium, silicon, hafnium, niobium, titanium, tantalum, rhenium, osmium, iridium, platinum, and alloys thereof. Generally, the part to be coated is not made of a corosion-resistant sulfide-forming metal and it must be previously coated with such a metal. For this purpose, the technique of cathode sputtering may advantageously be employed, using a cathode formed of the sulfide-forming metal, for instance cobalt. For the cathode sputtering of the sulfide-forming metal, as well as for the subsequent cathode sputtering of the composite sulfide lubricant, use may be made of a DC or AC electric voltage of high frequency, generally greater than 1 MHz, particularly 13.56 MHz, with a power density of between 2 $W/cm^2$ and 17 $W/cm^2$ and particularly between 3 $W/cm^2$ and 7 $W/cm^2$ . The sulfide-forming metal may be deposited to a thickness of at least 0.1 μm, for example, from about 0.5 to 5.0 μm.

After the sulfiding treatment, the purpose of which is to cause the composite lubricant coating to adhere firmly to its support, the simultaneous depositing of the chalcogen compound of layer structure and the hydrophobic solid polymer can be effected by cathodic sputtering in the same apparatus as that used for the sulfiding. The hydrophobic solid polymer can be a fluorocarbon such as polytetrafluoroethylene, a polyimide, or a silicone. The chalcogen compound of layer structure and the hydrophobic solid polymer can be placed in different cathodes connected in parallel, but it is preferable to place the two components in a common cathode, preferably in the form of a mixture of powders which has been compacted cold under a pressure of 100 to 10,000 bars and preferably 3,000 to 7,000 bars. The particles of the powders advantageously have an average size of less than 4 μm and preferably less than 1 μm. The relative proportions between the chalcogen compound of layer structure and the hydrophobic solid polymer are normally selected in such a manner as to obtain a composite lubricant coating in which the proportion of the hydrophobic solid polymer is between 1 and 80%, and more particularly between 5 and 40%, by weight of the composite coating.

The simultaneous cathode sputtering of the chalcogen compound of layer structure and the hydrophobic solid polymer and the possible preliminary cathode sputtering of the sulfide-forming metal are maintained for periods of time which lead to layers of sufficient thickness, that is to say, layers of a thickness generally equal to 1.5 to 2 times the height of its roughness, measured between peaks and hollows.

The surfaces coated by the process of the invention may be part of mechanical parts of any kind which are intended to rub on other surfaces, for instance shafts, plane bearings, ball or roller bearings, and in particular, also parts of microtechnical instruments or watch parts, for instance shafts and pivots of watch movements, particularly balance pivots and gearwheels of watches.

The following examples serve to illustrate the invention without limiting it.

EXAMPLE I

A cathode sputtering apparatus capable of operating at virtually vacuum conditions is used in which the pressure can be regulated between 0.1 millibars and 0.0001 millibars. The cathode holders can be connected to an alternating voltage of several kV with a frequency of 13 MHz and the anode holders can be connected to a direct negative potential of several kV. Steel parts to be coated, in the present case disks for a ball-disk wear test, are fastened to an anode holder, opposite two cathode holders one of which is covered either with nickel or with cobalt and the other with an $MoS_2$/PTFE mixture in a ratio of 80:20 by weight, of particles smaller than 1 μm, which has been prepared by cold-pressing under a pressure of 5000 bars. Before the sputtering, the disks are cleaned by subjecting them to ionic bombardment in a rare gas. For reasons of economy, argon is preferably employed as the rare gas. During this cleaning treatment, the sputtering cathodes are masked by a screen, the argon pressure is 0.01 millibars, and the anode has a negative potential of 800 V with respect to ground. The cathodic specific power is 3.3 W/cm$^2$ during the cleaning while it is 5.4 W/cm$^2$ in the subsequent operation.

Once such cleaning has been completed, the nickel or cobalt cathode is uncovered, the argon pressure is maintained at 0.01 millibars, the voltage of the anode with respect to ground is raised to −100 V and the metal of the cathode is allowed to deposit on the steel by cathode sputtering in order to form the layer of sulfidable metal. Once this layer has been deposited, hydrogen sulfide is added to the argon under a partial pressure of 0.001 millibars, the total pressure remaining 0.001 millibars, and the voltage of the anode is left unchanged at −100 V, while the layer of nickel or cobalt is sulfided. Thereupon the feed of $H_2S$ is interrupted, the anode is connected to ground, the $MoS_2$/PTFE cathode is unmasked, and the latter is cathodically sputtered so as to deposit the layer of composite solid lubricant on the disks.

The times of the different treatments are in general as follows: 10 minutes for the cleaning, 1 hour for the deposit of the sulfidable metal, 30 seconds for the sulfiding, and 30 minutes for the depositing of the composite solid lubricant.

Tests have shown that the argon should not contain more than 0.01% residual impurities.

In this example, the nickel and the cobalt can be replaced by rhodium, ruthenium, chromium, tungsten, palladium, copper, silicon, hafnium, niobium, titanium, molybdenum and tantalum as sulfidable metals.

The results of wear tests are given in Table I below. The conditions of the wear tests were as follows:

| | |
|---|---|
| Disk: | of steel |
| Load: | 5 N |
| Speed: | 0.6 meters/minute |
| Humidity of the air: | 52%. |

TABLE I

| Type of lubricant on disk | Life of lubricant M 0.3* (revolutions) | MTUF*$^X$ (minutes) |
|---|---|---|
| $MoS_2$ | 510 (a) | 106 (a) |
| $MoS_2$ + PTFE without carrier layer | 4800 (a) | 275 (a) |
| $MoS_2$ + PTFE on carrier layer of sulfided Ni | 8100 (a) | 400 (a) |
| $MoS_2$ | 1700 (b) | 50 (b) |
| $MoS_2$ + PTFE on carrier layer of sulfided Co | 39800 (b) | 1360 (b) |
| $MoS_2$ + PTFE on carrier layer of sulfided Rh | 1043000 (b) | 28000 (b) |
| $MoS_2$ | 350 (c) | 9 (c) |
| $MoS_2$ + PTFE on carrier layer of sulfided Ni | 63000 (c) | 1880 (c) |
| $MoS_2$ + PTFE on carrier layer of sulfided Ru | 350000 (b) | 4000 (b) |
| $MoS_2$ + PTFE on carrier layer of sulfided Cr | 13000 (b) | 300 (b) |
| $MoS_2$ + PTFE carrier layer of sulfided W | 37000 (b) | 720 (b) |
| $MoS_2$ + PTFE carrier layer of sulfided Pd | >600000 (b) | >15800 (b) |
| $MoS_2$ + PTFE on substrate of sulfided Cu | 5500 (b) | 450 (b) |
| $MoS_2$ + PTFE on substrate of sulfided Si | 8000 (b) | 206 (b) |
| $MoS_2$ + PTFE on substrate of sulfided Hf | 16000 (b) | 420 (b) |
| $MoS_2$ + PTFE on substrate of sulfided Nb | 21550 (b) | 650 (b) |
| $MoS_2$ + PTFE on substrate of sulfided Ti | 32000 (b) | 1180 (b) |
| $MoS_2$ + PTFE on substrate of sulfided Mo | 58240 (b) | 1680 (b) |
| $MoS_2$ + PTFE on substrate of sulfided Ta | 58100 (b) | 1500 (b) |
| $MoS_2$ + PTFE on substrate of sulfided W | 19400 (b) | 540 (b) |

(a) steel ball
(b) ruby ball
(c) steel ball covered with TiC
*M coefficient of friction
*$^X$average time until failure, defined as 10% increase of the mean coefficient of friction.

EXAMPLE II

The method of coating described in Example I above was applied to ball bearing rings and the bearings were subjected to comparative determinations of the number of revolutions required to exceed the value of 20 g.cm for the rolling moment M.

The bearings treated are of RMB-RA 619OX-J 630/1 without cage (made by Roulements Minatures S.A., Bienne, Switzerland). The inner and outer rings were coated with $MoS_2$+PTFE on a carrier layer of sulfided cobalt and, by way of comparison, with $MoS_2$ alone. The balls were of AISI 440 C steel and of AISI 52100 (DIN 100 Cr6) steel coated with TiC respectively.

The measurements were carried out in a relative humidity of 50%. The speed of rotation was 60 revolutions/minute.

The results are as follows:

TABLE II

| Balls | Rings coated with $MoS_2$ Number of revolutions up to M >20 g.cm | $MoS_2$ + PTFE on sulfided Co Number of revolutions up to M >20 g.cm |
|---|---|---|
| Steel | 12000 | 82000 |
| Steel + TiC | 560000 | 870000 |

The improvement in the life of the solid lubricant obtained as a result of the invention is clearly evident from the above results.

EXAMPLE III

Steel balance-wheel staffs of a mechanical watch of caliber MST 522 were treated in the manner described in the above examples in order to receive, in succession, a carrier layer of sulfided cobalt and a composite lubricant coating of $MoS_2$+PTFE. The balance wheels provided with staffs treated in this manner were subjected to the Balisometer test of the Laboratoire Suisse de Recherches Horlogeres (Swiss Research Laboratory of the Watchmaking Industry) for a total period of 90 days, during which the amplitude of the oscillation of the balance wheels in horizontal position was periodically measured. During the tests, the staffs were exposed to an atmosphere of a relative humidity of 40 to 50% and a temperature of 20°-22° C. By way of comparison, the same test was applied to balance wheels whose staffs were covered with a layer of $MoS_2$ alone. The results are given in Table III below, in which each value is the average of the measurements made on five samples.

TABLE III

| | Balance Wheel Oscillation Amplitude (Degrees) | |
|---|---|---|
| Days | $MoS_2$ | $MoS_2$ + PTFE on carrier layer of sulfided Co |
| 0 | 257 | 268 |
| 10 | 238 | 257 |
| 30 | 230 | 253 |
| 60 | 234 | 253 |
| 90 | 219 | 236 |

The amplitude of oscillation of the balance wheels whose pivots were treated in accordance with the invention remained greater than that of the balance wheels whose pivots were provided with a coating of $MoS_2$ along for the entire duration of the test.

Although specific components, proportions and arrangements of elements have been stated in the above description of preferred embodiments of this invention, other equivalent components and arrangements of elements may be used with satisfactory results and various degrees of quality, or other modifications may be made herein to synergize or enhance the construction of the invention to thereby increase its utility. It will be understood that such changes of details, materials, arrangements of elements, and uses of the invention described herein, are intended to be included within the principles and scope of the claimed invention.

What is claimed is:

1. A method of producing a corrosion-resistant solid lubricant coating on a corrosion-resistant surface consisting of a sulfide-forming metal, said method comprising subjecting the surface to an electric plasma in an atmosphere containing hydrogen sulfide so as to form a sulfide adhering to said surface and exposing the sulfided surface to simultaneous cathodic sputtering of at least one solid lubricant selected from the group consisting of the chalcogen compounds of layer structure and at least one hydrophobic solid polymer, so as to form a composite coating in which the particles of the chalcogen compound are protected by the hydrophobic polymer, the atmospheres in which the sulfiding and the depositing of the coating take place being devoid of free or combined oxygen.

2. The method of claim 1, wherein the sulfide-forming metal is selected from the group consisting of nickel, cobalt, chromium, molybdenum, copper, silver, rhodium, tungsten, palladium, silicon, hafnium, niobium, titanium, tantalum, rhenium, osmium, iridium, platinum, and alloys thereof.

3. The method of claim 1, wherein the sulfide-forming metal is ruthenium and alloys thereof.

4. The method of any one of the preceding claims, wherein the chalcogen compound is molybdenum sulfide.

5. The method of any one of claims 1-3, wherein the hydrophobic solid polymer is a fluorocarbon.

6. The method of any one of claims 1-3, wherein the hydrophobic solid polymer is selected from the group consisting of: polytetrafluoroethylene, polyimides and silicones.

7. The method of any one of claims 1-3, wherein the chalcogen compound and the hydrophobic solid polymer to be applied by cathode sputtering are mixed in a common cathode.

8. The method of claim 7, wherein the sputtering cathode is obtained by cold compacting of a mixture of particulate chalcogen compound and the hydrophobic solid polymer, with the application of a pressure in the range of about 100 to 10,000 bars.

9. The method of claim 8, wherein said cathode was obtained with application of pressure in the range of about 3,000 to 7,000 bars.

10. The method of claim 8, wherein the particles have an average particle size of less than about 4 μm.

11. The method of claim 8 wherein the particles have an average particle size of less than about 1 μm.

12. The method of any one of claims 1-3, wherein the method forms a lubricating coating containing from about 1 to 80% of hydrophobic solid polymer.

13. The method of claim 12, wherein the method forms a lubricating coating containing from about 5 to 40% of hydrophobic solid polymer.

14. The method of any of claims 1-3, wherein the lubricating coating has a thickness equal to about 1.5 to 2 times the height of its roughness, measured between peaks and hollows.

15. The method of any one of claims 1-3, wherein the surface formed of a sulfide-forming metal is obtained by cathodic sputtering of the metal on a substrate.

16. The method of claim 15, wherein the cathodic sputtering of the sulfide-forming metal is effected by an alternating electric voltage of high frequency.

17. The method of claim 15, wherein said layer of sulfide-forming metal has a thickness of at least 0.1 μm.

18. The method of claim 15 of forming a layer of sulfide-forming metal having a thickness of from about 0.5 to 5 μm.

19. The method of claim 15, wherein the deposit of the sulfide-forming metal, its sulfiding and the formation of the composite coating are carried out in the same enclosure.

* * * * *